US007950697B2

(12) United States Patent
Werner

(10) Patent No.: US 7,950,697 B2
(45) Date of Patent: May 31, 2011

(54) BOOK, IN PARTICULAR AN ALBUM

(76) Inventor: Nadine Werner, Clenze (DE)

( * ) Notice: Subject to any disclaimer, the term of this patent is extended or adjusted under 35 U.S.C. 154(b) by 742 days.

(21) Appl. No.: 11/907,261

(22) Filed: Oct. 10, 2007

(65) Prior Publication Data

US 2008/0088121 A1 Apr. 17, 2008

(30) Foreign Application Priority Data

Oct. 11, 2006 (DE) ..... 20 2006 015 698 U

(51) Int. Cl.
*B42D 1/00* (2006.01)
*B42F 3/00* (2006.01)
*B42F 13/02* (2006.01)

(52) U.S. Cl. ..... 281/21.1; 281/15.1; 281/28; 402/8

(58) Field of Classification Search ..... 281/15.1, 281/21.1, 28, 29, 31, 35, 36, 38, 51; 283/81, 283/115; 402/8, 9, 13, 19, 57
See application file for complete search history.

(56) References Cited

U.S. PATENT DOCUMENTS

| | | | | |
|---|---|---|---|---|
| 4,280,241 | A * | 7/1981 | Pfaff | 281/29 |
| 5,620,206 | A * | 4/1997 | Flores | 281/15.1 |
| 5,902,659 | A * | 5/1999 | Lewin | 283/81 |
| 7,258,367 | B2 * | 8/2007 | Legrand | 281/15.1 |

FOREIGN PATENT DOCUMENTS

| | | |
|---|---|---|
| EP | 1911600 B1 | 4/2009 |
| FR | 83371 | 12/1964 |
| WO | WO 97/37858 | 10/1997 |

OTHER PUBLICATIONS

European Search Report for EP Publication No. EP 1911600, Jan. 17, 2008.

* cited by examiner

*Primary Examiner* — Dana Ross
*Assistant Examiner* — Justin V Lewis
(74) *Attorney, Agent, or Firm* — Kubotera & Associates LLC

(57) ABSTRACT

Book, in particular an album, characterised by two front and back covers which are separate from each other and are joined with a spacing from each other by at least one flat strip-like spine part, the portion of the spine part between the opposing inner edges of the two covers being foldable in the manner of a concertina into a predetermined number of peak folds of the same height, and four respective pages being formed by a centrally folded sheet which has, at the centre along the fold, at least one narrow slotted opening of predetermined length and width for feeding through a peak fold which projects above the slotted opening in at least one sheet at such a height that a narrow, web-like connecting element is configured so as to be insertable through the protruding opening in the peak fold for detachable connection to the book.

7 Claims, 1 Drawing Sheet

BOOK, IN PARTICULAR AN ALBUM

Figure 1:
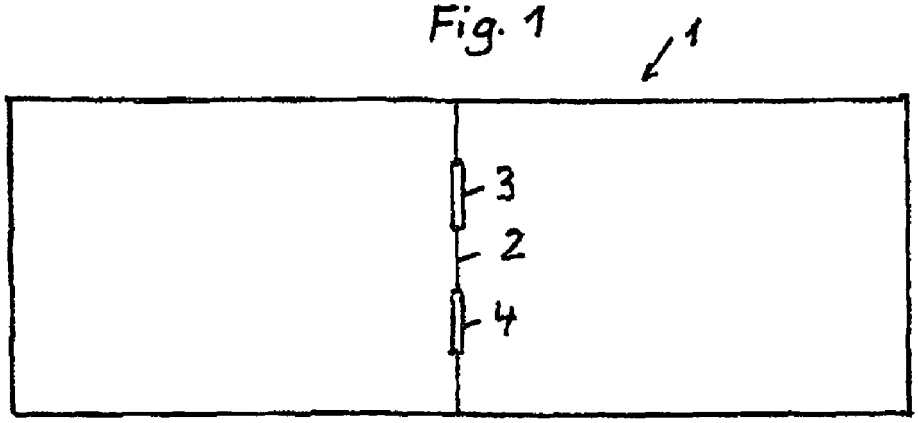

The invention or innovation relates to a book, in particular an album comprising a selected number of pages.

Books and albums are conventionally adhesive-bound, stitched or the book block is held with bookbinding screws or a clamping device. Only in the latter two variations are the pages exchangeable. All the exchangeable variations have the drawback that the book/album cannot be placed down flat when opened.

The object of the invention is to disclose a book/album in which the pages/quires are exchangeable and which can always lie flat when opened. This object is achieved by two front and back covers which are separate from each other and are joined with a spacing from each other by at least one flat strip-like spine part, the portion of the spine part between the opposing inner edges of the two covers being foldable in the manner of a concertina into a predetermined number of peak folds of the same height, and four respective pages being formed by a centrally folded sheet which has, at the centre along the fold, at least one narrow slotted opening of predetermined length and width for feeding through a peak fold which projects above the slotted opening in at least one sheet at such a height that a narrow, web-like connecting element is configured so as to be insertable through the protruding opening in the peak fold for detachable connection to the book.

It may be advantageous in this regard for a peak fold to be configured so as to be insertable through slotted openings in two or more double sheets, positioned one above another, in such a way that a connecting element is configured so as to be insertable through the opening, projecting beyond the quire, in the peak fold for common detachable connection of the quire to the book.

It may also be advantageous for there to be arranged set apart from one another two or more parallel, strip-like spine parts of selected width which jointly interconnect the two covers in the same manner and for the portions of the spine parts each to be folded between the opposing inner edges of the two covers in the same, concertina-like manner into the same number of peak folds, the mutually opposing peak folds of the strip-like materials each being axially aligned with one another and the double sheets each having at the centre along their folds, in accordance with the number of spine parts, two or more slotted openings for the feeding-through of axially aligned peak folds, opposing the openings, of the spine parts.

The spine part or parts may in this case be integral with the type areas fastened to the insides of the front and back cover or with the jacket fastened on the outside to the two covers.

It is advantageous if the web-like connecting element is made of a non-buckling material, for example a strip made of metal or plastic material or a rigid cardboard, at least one end of the connecting element having rounded corners to facilitate insertion.

An advantageous embodiment of the book according to the invention is also characterised in that one or more pairs of covers are each formed from the front and back covers of a book with in each case one or more connected spine parts per pair of covers having the same or a different number of peak folds and a selected number of double sheets with longitudinal slots, and the associated connecting parts are configured so as to be able to be joined together by hand for making a book with a selectable number of sheets as loose individual parts of a set.

Each pair of covers can in this case be configured so as to be assemblable from a loose front and a loose back cover and the loose type areas to be secured on the inside to the two covers or a jacket which is to be secured on the outside and is made of paper or foldable cardboard, which are formed in one piece with the spine parts and their folded peak folds, wherein the number of peak folds can be selected differently for each pair of covers.

The zigzag peak folds, which are folded in the manner of a concertina or accordion, in a central portion of one or more strips forming the spine between the front and the back cover can be made of relatively strong cardboard and can be rigidly connected at the type areas, on each case on the inside, to the two covers or else to the outer jacket or else can be formed in one piece with the two type areas or the jacket.

However, according to the invention, the spine strips may also be integral with the two covers which may each be made, in double size, of a grooved sheet of cardboard which can be folded along the grooves (fold) to impart rigidity to the cover. A folded cover may also be connected without adhesion, so the book or album finished in accordance with the invention can be assembled—even by non-professionals—without adhesive and then be taken apart again. It is in this case particularly advantageous that individual sheets or quires can be removed from an album or exchanged without the album becoming damaged in the process. For this purpose, the respective web-like connecting element merely has to be extracted from the associated peak fold. For this purpose, the peak folds and the associated connecting elements are adapted to one another in such a way that the connecting elements are configured so as to be insertable into the peak folds, protruding out of the slotted openings in a sheet or a quire, with predetermined resistance such that they cannot slide out of the openings of their own accord.

The invention also affords the possibility of a particularly tasteful design of a book or album if two or more strip-like spine parts with their accordion-like folds are present and the colours of these spine parts characteristically differ from the colours of the web-like connecting elements which are visible between the spine parts, which are set apart from one another, and in the region of the upper and lower lateral edges of the covers.

Figure 2:
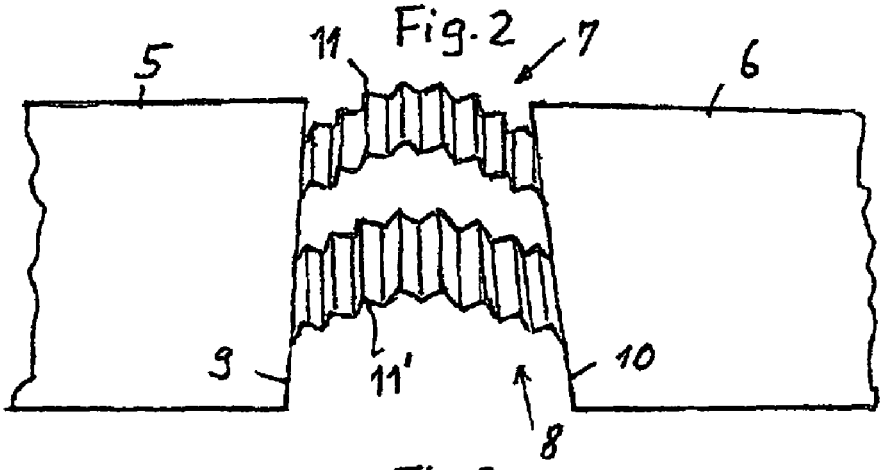
Figure 3:
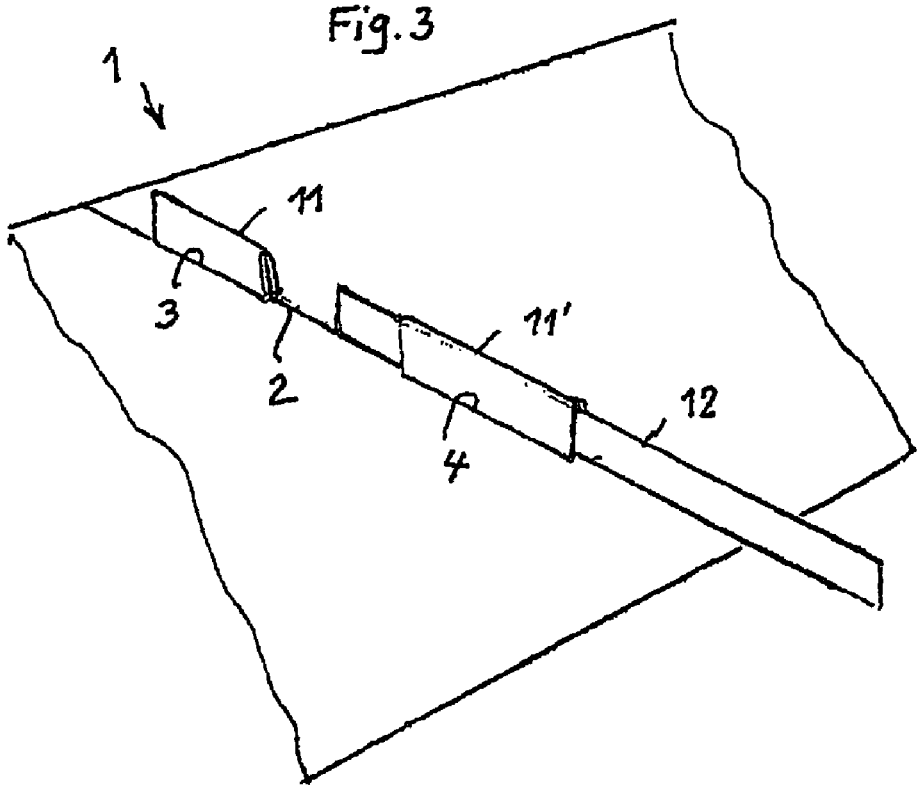

An embodiment of the invention is illustrated schematically with reference to the drawings, in which:

FIG. 1 is a plan view of a quadrilateral sheet of the book or album according to the invention;

FIG. 2 is a perspective view, obliquely from above, of portions, close to the spine, of the front and back cover connected to accordion-like spine strips; and FIG. 3 is a perspective view of the central part of the sheet, shown in enlarged scale, according to FIG. 1 with two spine folds protruding through its two slots and a connecting element in a position for partial insertion into the slot in the spine fold.

In FIG. 1, denoted by reference numeral 1 is a quadrilateral sheet of the book or album according to the invention having at its centre a groove or a fold 2 running through two central slots 3 and 4 which have a specific width and length and are both of identical configuration. The sheet 1, made for example of a thin rigid cardboard, is foldable along its groove or fold 2 and forms four sides of a book or album according to the invention.

FIG. 2 shows a part, close to the spine, of a front and a rear cover 5 and 6 of sufficient strength. The two covers 5 and 6 are rigidly connected to each other at a predetermined spacing by two spine strips 7 and 8 arranged in parallel. Between the inner, mutually opposing edges 9 and 10, the spine strips are folded in the manner of an accordion in a zigzag shape. In other words, the spine strips 7 and 8 are each folded in the manner of a concertina between the inner cover edges 9 and 10 into peak folds of equal height, of which one of the two spine strips is denoted by reference numeral 11, of which two respective peak folds of the spine strips 7 and 8 are aligned with each other in the longitudinal direction.

The number of peak folds and the length and height thereof are selected in such a way that two respective aligned peak folds can be fed through the two slots 3 and 4 in a sheet.

FIG. 3 is an enlarged view of the central part of the sheet 1 with two peak folds 11, 11' protruding through the slots 3 and 4 and a narrow, web-like connecting element 12 in its position of partial insertion in which it has been fed through the narrow opening in the sheet fold 11' above the sheet 1.

To fasten the centrally slotted sheet 1 to the two spine strips 7 and 8, the connecting element 12 is also pushed through the narrow opening in the second peak fold 11. The narrow, web-like connecting element 12 made of rigid cardboard, plastic material or metal is in this case of a length such that, in the position of full insertion, its leading and trailing ends are located in the region of the parallel lateral edges of the covers. The edges can be rounded at least at one end to facilitate insertion of the web-like connecting elements.

In the exemplary case, the book or album according to the invention has eight quadrilateral sheets 1 which are each detachably held, using a web-like connecting element 12, on two aligned peak folds of the spine strips 7 and 8, for which purpose two pairs of peak folds each protrude through the slots 3 and 4 in the sheets in such a way that a web-like connecting element 12 is insertable through the openings, projecting beyond the sheets, in the peak folds.

In the exemplary case in FIG. 2, the spine strips are integral with the two covers.

However, in FIG. 2, the partial portions 5 and 6 can also be type areas which are each fastened to the insides of the two covers.

At their ends, the spine strips 7 and 8 can each have flattered portions which are rigidly connected, for example bonded, to the type areas or the covers.

The embodiment, shown in the drawings merely by way of example, of individual parts of an assemblable book or album according to the invention will directly encourage a person skilled in the art to think of modified books or albums which do not depart from the basic idea of the invention.

The invention claimed is:

1. Book, in particular an album, characterised by two front and back covers which are separate from each other and are joined with a spacing from each other by at least one flat strip-like spine part, the portion of the spine part between the opposing inner edges of the two covers being foldable in the manner of a concertina into a predetermined number of peak folds of the same height, and four respective pages being formed by a centrally folded sheet which has, at the centre along the fold, at least one narrow slotted opening of predetermined length and width for feeding through a peak fold which projects above the slotted opening in at least one sheet at such a height that a narrow, web-like connecting element is configured so as to be insertable through the protruding opening in the peak fold for detachable connection to the book, wherein a peak fold is configured so as to be insertable through slotted openings in each case in two or more double sheets, positioned one above another, in such a way that a connecting element is configured so as to be insertable through the opening, projecting beyond a quire, in the peak fold for common detachable connection of the quire to the book, having at least two or more quires characterized in that there are arranged set apart from one another two or more parallel, strip-like spine parts of selected width which jointly interconnect the two covers in the same manner and the portions of the spine parts are each folded between the opposing inner edges of the two covers in the same, concertina-like manner into the same number of peak folds, the mutually opposing peak folds of the strip-like materials each being axially aligned with one another and the quires each having at the centre along their folds, in accordance with the number of spine parts, two or more slotted openings for the feeding-through of axially aligned peak folds, opposing the openings, of the spine parts.

2. Book according to claim 1, characterised in that the spine part or parts are integral with the type areas of the front and back cover or with the outer jacket.

3. Book according to claim 1, characterised in that the web-like connecting element is made of a non-buckling material.

4. Book according to claim 3, characterised in that the connecting element consists of a strip made of metal or plastics material or non-buckling cardboard.

5. Book according to claim 3, characterised in that the connecting element has rounded corners at least at one end.

6. Book according to claim 1, characterised in that one or more pairs of covers are each formed from the front and back covers of a book with in each case one or more connected spine parts per pair of covers having the same or a different number of peak folds and a selected number of double sheets with longitudinal slots, and the associated connecting parts are configured so as to be able to be joined together by hand for making a book with a selectable number of sheets as loose individual parts of a set.

7. Book according to claim 6, characterised in that each pair of covers is configured so as to be assemblable from a loose front and a loose back cover and the loose type areas to be secured on the inside to the two covers or a jacket which is to be secured on the outside and is made of paper or foldable cardboard, which are formed in one piece with the spine parts and their folded peak folds, wherein the number of peak folds can be selected differently for each pair of covers.

* * * * *